US008253079B2

(12) United States Patent
Wang

(10) Patent No.: US 8,253,079 B2
(45) Date of Patent: Aug. 28, 2012

(54) TEMPERATURE-CONTROL CIRCUIT OF A HEATING LINE AND A TEMPERATURE-CONTROL METHOD THEREOF

(76) Inventor: Ching-Chuan Wang, Keelung (TW)

( * ) Notice: Subject to any disclaimer, the term of this patent is extended or adjusted under 35 U.S.C. 154(b) by 203 days.

(21) Appl. No.: 12/801,984

(22) Filed: Jul. 7, 2010

(65) Prior Publication Data

US 2011/0204040 A1 Aug. 25, 2011

(30) Foreign Application Priority Data

Feb. 24, 2010 (TW) ..... 99105273 A

(51) Int. Cl.
*H05B 1/02* (2006.01)

(52) U.S. Cl. ..... 219/501; 219/505; 219/504; 219/510; 219/511; 219/251; 219/250

(58) Field of Classification Search ..... 219/505, 219/504, 510, 511, 250, 251, 501
See application file for complete search history.

(56) References Cited

U.S. PATENT DOCUMENTS 5,380,983 A * 1/1995 Cavada et al. ..... 219/250
6,426,831 B1 * 7/2002 Schmidt et al. ..... 359/326
6,822,372 B2 * 11/2004 Puskas ..... 310/317
7,211,928 B2 * 5/2007 Puskas ..... 310/317

* cited by examiner

*Primary Examiner* — Viet Q Nguyen
(74) *Attorney, Agent, or Firm* — Bacon & Thomas, PLLC

(57) ABSTRACT

A temperature-control circuit of a heating line and a temperature-control method thereof are disclosed. The method comprises steps of: outputting a forward square-wave signal by a first forward square-wave signal generation circuit; outputting a reverse square-wave signal by a reverse square-wave signal generation circuit; and outputting a varied forward square-wave signal by a second forward square-wave signal generation circuit. Above square-wave signal generation circuits are respectively connected with an AND gate. When the input square-wave signals are simultaneously logic high, a switch is triggered by a trigger circuit to heat the heating wire. When the heating wire's temperature increases, the forward square-wave signal output by the second forward square-wave signal generation circuit is changed so as to render these input square-wave signals non-simultaneously logic high and not to trigger the switch in order to stop the heating wire's heating and keep the heating wire at a certain temperature range.

15 Claims, 9 Drawing Sheets

TEMPERATURE-CONTROL CIRCUIT OF A HEATING LINE AND A TEMPERATURE-CONTROL METHOD THEREOF

TECHNICAL FIELD

The present invention relates to a temperature-control circuit and, more particularly, to a temperature-control circuit of a heating line and a temperature-control method thereof suitable for heaters such as electrothermal furnaces and heating pads.

BACKGROUND

Heaters such as heating pads are widely available in the market currently. Usually, the heating of a heating line will be automatically interrupted on condition that the temperature reaches the temperature preset by users. Thereby, the temperature of the heaters can be kept within a preset range in order to provide functions such as hot compression while ensure the safety of the users.

In order to control temperature effectively, as described in a U.S. Pat. No. 5,861,610, an element of positive temperature coefficient (abbreviated as PTC hereinafter) is used as a detection line for sensing the temperature change, and consequently the element can be used together with a heating line for temperature-controlled heating. The temperature of the detection line is compared by a comparison circuit in a controller when the temperature of the heating line is rising or the resistance of the detection line is changed by the high temperature. The electric current input into the heating line can be adjusted based on the comparison result in order to keep the heating temperature within the range preset by users.

Above technique is also disclosed in other U.S. Pat. No. 6,300,597, U.S. Pat. No. 6,310,322, and U.S. Pat. No. 6,768,086. In one U.S. Pat. No. 7,180,037, the application of another PCT element or an element of negative temperature coefficient (abbreviated as NTC hereinafter) is disclosed. In this patent, the technical feature distinguished from above conventional techniques is that: a first zero cross signal in response to the detection of a zero crossing of the AC power signal; a second zero cross signal in response to the zero crossing of the phase shifted AC power signal produced by detecting that the resistor of a PTC or NTC element is changed due to temperature; a time difference determinator circuit used to measure the phase-shift time of the first zero cross signal and the second zero cross signal continually; a controller used for calculation and outputting a control signal to render the circuit in conducting or disconnecting state; consequently, the temperature of the heating can be kept within a certain range.

The whole circuit configuration disclosed in above U.S. Pat. No. 7,180,037 is quiet complicated. Moreover, the temperature-control function can be performed only by the detection and calculation of the time difference determinator circuit and the controller. However, the manufacturing cost would be increased.

In order to overcome above shortcomings, inventor had the motive to study and develop the present invention to provide a temperature-control circuit of a heating line and a temperature-control method thereof, which are distinguished from above prior arts and have advantages of effectively controlling temperature, simplifying component elements, and saving the manufacturing cost.

SUMMARY OF THE DISCLOSURE

An object of the present invention is to provide a temperature-control circuit of a heating line and a temperature-control method thereof, where a first forward square-wave signal, a reverse square-wave signal, and a second forward square-wave signal that is varied with temperature change are input into AND gate; the AND gate sends off signal after making judgment for controlling the heating line to increase or decrease temperature. Thereby, the heating continues at low temperature and stops at high temperature in order to keep the heating temperature within the range preset by users.

Another object of the present invention is to provide a temperature-control circuit of a heating line and a temperature-control method thereof, where a first forward square-wave signal, a reverse square-wave signal, and a second forward square-wave signal that is varied with temperature change are input into AND gate; the AND gate sends off signal after making judgment for controlling the heating line to increase or decrease temperature. Thereby, users can flexibly adjust the heating temperature.

In order to achieve above objects, the present invention provides a temperature-control circuit of a heating line, where the heating line comprises a heating wire, a sensing line, an insulation-and-meltable layer located between the heating wire and the sensing line, and a cladding layer covering the outer peripheries of the sensing line and the insulation-and-meltable layer. One end of the heating wire is coupled with one polarity of power while another end thereof is connected with a switch that is coupled with a reverse polarity of the power. The temperature-control circuit comprises a first forward square-wave signal generation circuit, a reverse square-wave signal output circuit, a second forward square-wave signal generation circuit, an AND gate, and a trigger circuit. The first forward square-wave signal generation circuit is for outputting a first forward square-wave signal. The reverse square-wave signal output circuit includes a first RC circuit, a first voltage comparator, and a voltage adjustment circuit. The RC circuit is in serial connection with the first forward square-wave signal generation circuit. A first node is provided between the first RC circuit and the first forward square-wave signal generation circuit while a second node is provided between the resistor and the capacitor of the first RC circuit. The non-inverting input end of the first voltage comparator is coupled with the voltage adjustment circuit for inputting an adjusted voltage. The inverting input end of the first voltage comparator is coupled with the second node for outputting reverse square-wave. The second forward square-wave signal generation circuit includes a capacitor and a second voltage comparator, where the capacitor is in serial connection with the sensing line; a third node is provided between the sensing line and the capacitor; and the non-inverting input end of the second voltage comparator is coupled with the third node for outputting second square-wave signal. The AND gate is provided with three input ends that are respectively connected with the output end of the first voltage comparator, the first node, and the output end of the second voltage comparator. The trigger circuit is respectively connected with the output ends and the switch.

Thereby, when the three input ends of the AND gate have logic-high input simultaneously, the switch is triggered to be in conducting state to heat the heating wire; when the three input ends of the AND gate have logic-high input non-simultaneously, the switch is not triggered so as to stop the heating of the heating wire.

The present invention also provides a temperature-control method for a temperature-control circuit of a heating line, comprising steps of: a. outputting a first forward square-wave signal by a first forward square-wave signal generation circuit; b. inputting the first forward square-wave signal into a first input end of an AND gate; after charging and discharging the split-flow of the first forward square-wave signal, comparing it with an adjusted voltage; after above comparison, outputting a reverse square-wave to a second input end of the AND gate; c. comparing the signal passing through the sensing line by a second voltage comparator and outputting a second forward square-wave signal to a third input end of the AND gate; and d. triggering the switch by a trigger circuit and rendering the switch in conducting state so as to heat the heating wire when the three input ends of the AND gate have logic-high input simultaneously; stopping triggering the switch and stopping the heating of the heating wire when the second forward square-wave signal output by the second voltage comparator is moved by the rising temperature and the three input ends of the AND gate have logic-high input non-simultaneously.

The following detailed description, given by way of examples or embodiments, will best be understood in conjunction with the accompanying drawings.

DETAILED DESCRIPTION

The temperature-control method for a temperature-control circuit of a heating line according to the present invention comprises steps of:

a. outputting a first forward square-wave signal by a first forward square-wave signal generation circuit;

b. inputting the first forward square-wave signal into a first input end of an AND gate; after charging and discharging the split-flow of the first forward square-wave signal, comparing it with an adjusted voltage; outputting a reverse square-wave after above comparison to a second input end of the AND gate;

c. comparing the signal passing through the sensing line by a second voltage comparator and outputting a second forward square-wave signal to a third input end of the AND gate; and d. triggering the switch by a trigger circuit and rendering the switch in conducting state so as to heat the heating wire when the three input ends of the AND gate have logic-high input simultaneously; stopping triggering the switch and stopping the heating of the heating wire when the second forward square-wave signal output by the second voltage comparator is moved by the rising temperature and the three input ends of the AND gate have logic-high input non-simultaneously The voltage of each square-wave signal is above zero no matter the signal is forward or reverse. Besides, the "reverse" is defined as following: when the reverse square-wave signal is at low potential, the forward square-wave signal is at high potential; when the reverse square-wave signal is at high potential, the forward square-wave signal is at low potential.

Figure 1:
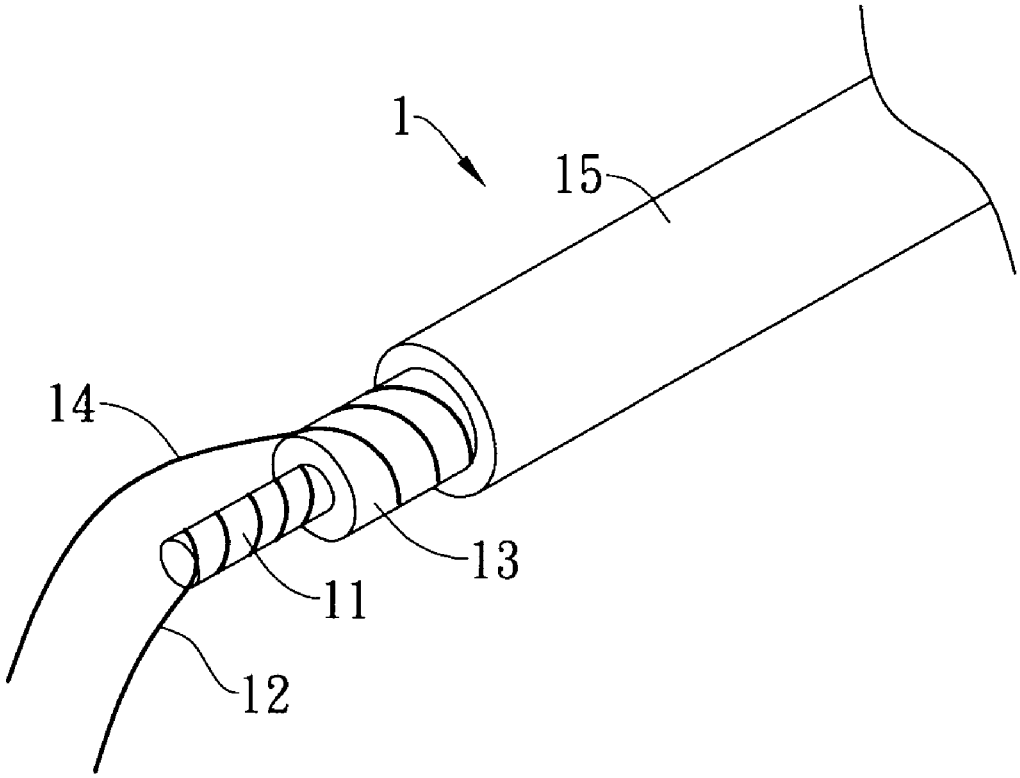
FIG. 1 is a perspective view of a heating line of the present invention.
Figure 2:
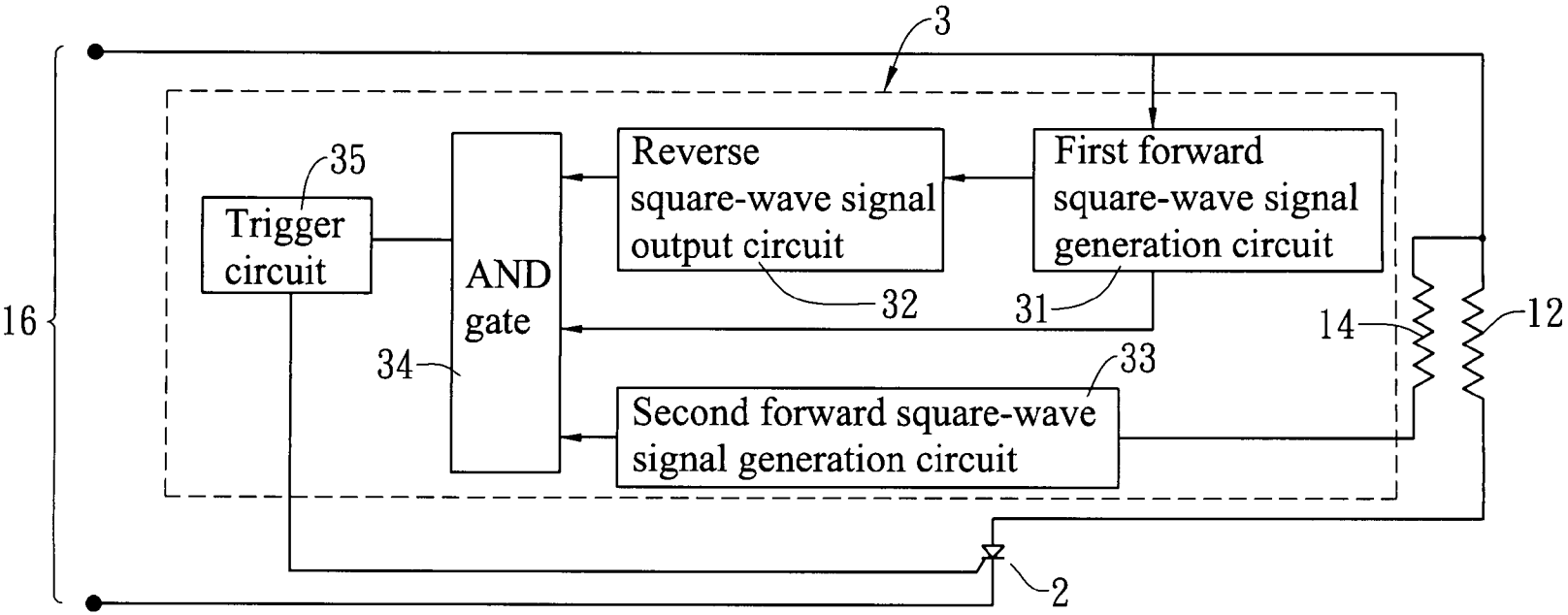
FIG. 2 is a circuit block diagram showing the temperature-control circuit of the present invention.

As shown in FIGS. 1 and 2, the heating line comprises a core material 11, a heating wire 12 coiled around the outer peripheries of the core material 11, an insulation-and-meltable layer 13 covering the heating wire 12 and the core material 11, a sensing line 14 coiled around the outer peripheries of the insulation-and-meltable layer 13, and a cladding layer 15 covering the outer peripheries of the sensing line 14 and the insulation-and-meltable layer 13. One end of the heating wire 12 is coupled with one polarity of power 16 while another end of the heating wire 12 is connected with a switch 2 that is coupled with a reverse polarity of the power 16, so as to render the heating wire 12, the switch 2, and the power 16 in serial connection in order to form a circuit for heating the heating wire 12. In this case, the heating wire 12 is of positive temperature coefficient. Alternatively, the heating wire 12 also can be of negative temperature coefficient. Moreover, the temperature-control circuit 3 is respectively connected with the sensing line 14 and the switch 2 for continuing or stopping heating the heating wire 12.

According to above temperature-control method, the temperature-control circuit 3 of the present invention comprises a first forward square-wave signal generation circuit 31, a reverse square-wave signal output circuit 32, a second forward square-wave signal generation circuit 33, an AND gate 34, and a trigger circuit 35. The first forward square-wave signal generation circuit 31 is for outputting a first forward square-wave signal. The reverse square-wave signal output circuit 32 is for outputting a reverse square-wave signal that has been charged and discharged. The second forward square-wave signal generation circuit 33 is for outputting a varied forward square-wave signal. After receiving three input square-wave signals, the AND gate 34 outputs a signal to the trigger circuit 35 for controlling the trigger circuit 35 to trigger the switch 2 and thus determining whether the heating wire 12 is heated or not.

Figure 3:
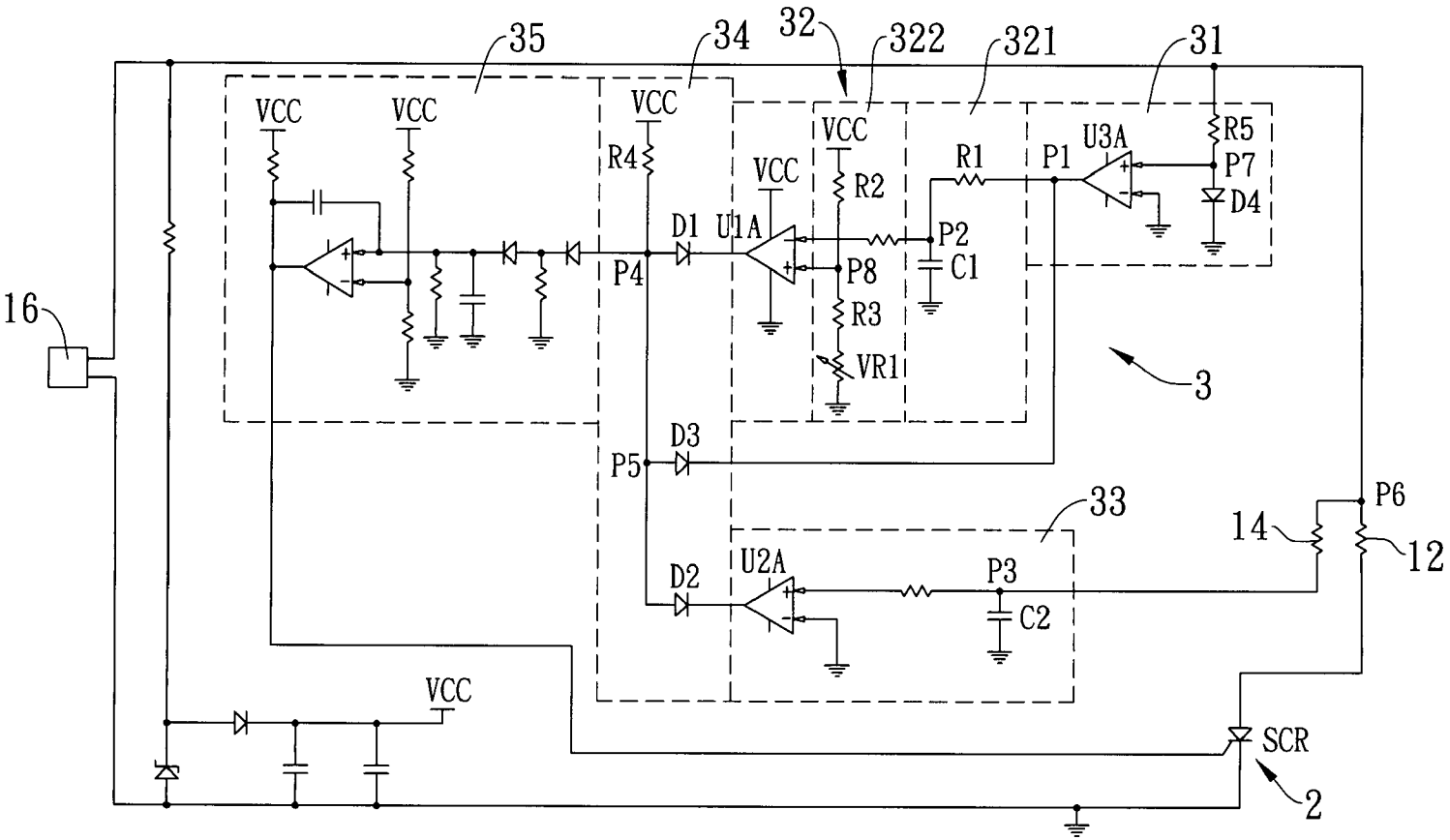
FIG. 3 is a circuit diagram showing a first embodiment of the temperature-control circuit of the present invention.

Please refer to FIG. 3 showing a circuit diagram of a first embodiment of the temperature-control circuit 3 of the present invention. In this embodiment, the power 16 is an AC power for outputting a sine wave signal of 110 volts and 60 Hz. A sixth node P6 is provided between one polarity of the power 16 and the heating wire 12. Besides, one end of the sensing line 14 is coupled with the sixth node P6.

The first forward square-wave signal generation circuit 31 includes a resistor R5 and a diode D4 that are in serial connection. One end of the resistor R5 is coupled with one polarity of the power 16. The diode D4 has one end in ground connection. A seventh node P7 is provided between the resistor R5 and the diode D4. The non-inverting input end of the third voltage comparator U3A is coupled with the seventh node P7. The inverting input end of the third voltage comparator U3A is in ground connection so as to covert the sine wave signal to the first forward square-wave signal.

Figures 4, 5:
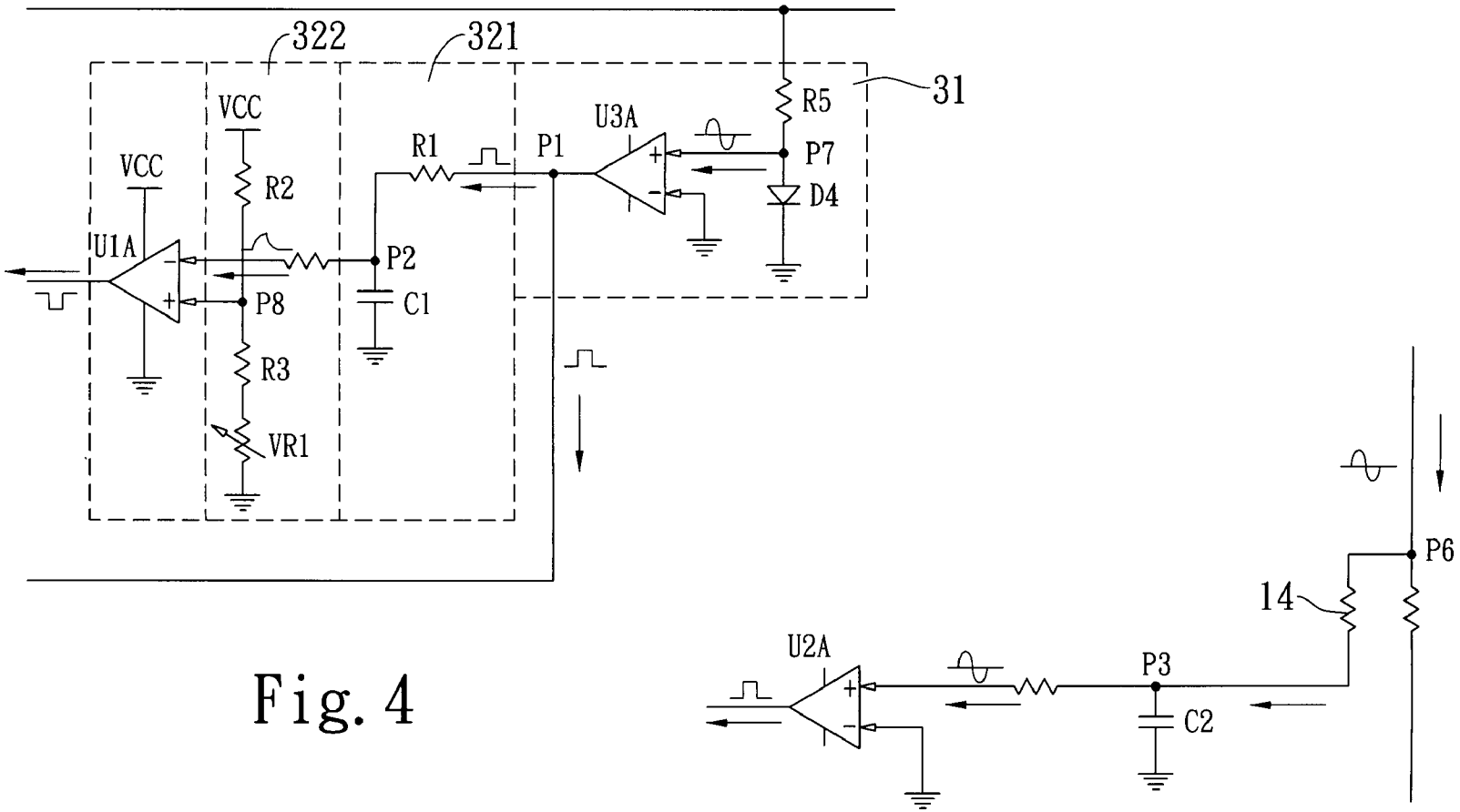
FIG. 4 is a schematic view showing the output waveform change of a first forward square-wave signal generation circuit and a reverse square-wave signal generation circuit of the present invention.
FIG. 5 is a schematic view showing the output waveform change of a second forward square-wave signal generation circuit of the present invention.

The reverse square-wave signal output circuit 32 includes a first RC circuit 321, a voltage adjustment circuit 322, and a first voltage comparator U1A. The resistor R1 of the first RC circuit 321 is connected with the output end of the third voltage comparator U3A, and a first node P1 is provided between the output end and the resistor R1. A second node P2 is provided between the resistor R1 and the capacitor C1 of the first RC circuit 321. The voltage adjustment circuit 322 has resistors R2, R3 and a variable resistor VR1, where an eighth node P8 is provided between the resistors R2, R3. The non-inverting input end of the first voltage comparator U1A is coupled with the eighth node P8. The inverting input end of the first voltage comparator U1A is coupled with the second node P2. As shown in FIG. 4, the output square-wave signal from the output end of the third voltage comparator is charged and discharged via the first RC circuit 321 and is input into the first voltage comparator U1A so as to output a reverse square-wave signal. The divided voltage inputting into the non-inverting input end of the first voltage comparator U1A is provided by the voltage adjustment circuit 322 and can be used as a comparison reference voltage for pre-input of the first voltage comparator U1A after the variable resistor VR1 is adjusted by users.

The second forward square-wave signal generation circuit 33 includes a capacitor C2 and a second voltage comparator U2A. The capacitor C2 and the sensing line 14 are in serial connection, and the sensing line 14 and the capacitor C2 form a second RC circuit. Thereby, when the sensing 14 detects temperature rising and changes the resistor, the RC time constant of the second RC circuit will be changed accordingly. Moreover, a third node P3 is provided between the sensing line 14 and the capacitor C2. The non-inverting input end of the second voltage comparator U2A is coupled with the third node P3 while the inverting end of the second voltage comparator U2A is in ground connection. As shown in FIG. 5, by means of the characteristic of RC time constant of the second RC circuit formed by the sensing line 14 and the capacitor C2, the input sine wave signal from the power 16 can be delayed. The delayed sine wave signal is then undergone voltage comparison via the second voltage comparator U2A so as to output the second forward square-wave signal.

The AND gate 34 includes a first diode D1, a second diode D2, and a third diode D3 that are in parallel connection. One end of the second diode D2 is connected with the output end of the second voltage comparator U2A while another end of the second diode D2 is connected with one polarity of the power 16. Besides, a fourth node P4 and a fifth node P5 are provided between the second diode D2 and the power. Two ends of the first diode D1 are respectively coupled with the output end of the first voltage comparator U1A and the fourth node P4. The two ends of the third diode D3 are respectively coupled with the first node P1 and the fifth node P5. In practice, the AND gate 34 also can be replaced by a microprocessor having the same functions. The trigger circuit 35 is respectively connected with the output end of the AND gate 34 and the gate of the switch 2. The switch 2 is a silicon-controlled-rectifier (SCR). Besides, the switch 2 also can be a thyristor, such as a TRIAC.

Figure 6:
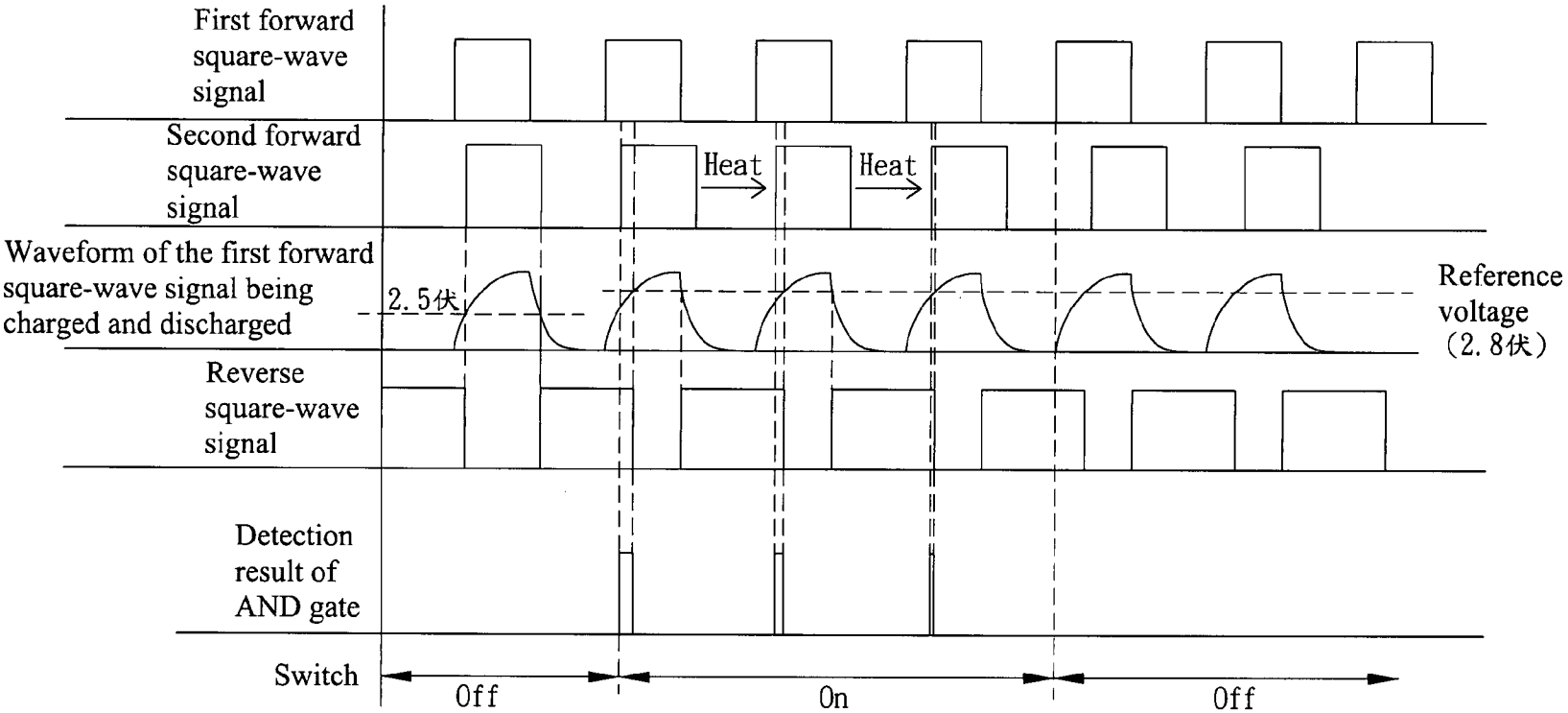
FIG. 6 is a schematic view showing the change of a first forward square-wave signal, a reverse square-wave signal, and a second forward square-wave signal which are used for determining whether the switch is in conducting or in disconnecting state.

Please refer to FIG. 6 showing the waveform change of a first forward square-wave signal, a reverse square-wave signal, and a second forward square-wave signal sent during the heating wire 12 is in conducting or in disconnecting state. When the voltage adjustment circuit 322 sets the reference voltage to be 2.5 volts, the switch 2 is in disconnecting (off) state. When the reference voltage is adjusted to be 2.8 volts, the switch 2 begins to be in conducting (on) state. In practice, the reference voltage is adjustable according to users' needs so as to control the heating temperature of the heating wire 12.

As shown in FIGS. 3 and 6, the first forward square-wave signal generation circuit 31 outputs the first forward square-wave signal to the third diode D3 via the first node P1. The second forward square-wave signal generation circuit 33 outputs the second forward square-wave signal to the second diode D2 via the output end of the second voltage comparator U2A. The reverse square-wave signal output circuit 32 outputs the reverse square-wave signal to the first diode D1 via the output end of the first voltage comparator U1A. Thereby, when the first forward square-wave signal, the second forward square-wave signal, and the reverse square-wave signal are all in logic-high state simultaneously, the three diodes D1, D2, D3 are all in disconnecting state. Under this condition, the current of the power 16 will trigger the switch 2 via the trigger circuit 35 to begin and keep the heating of the heating wire 12 for a while. The rising temperature of the heating wire 12 will change the resistance of the sensing line 14 and consequently change the time interval between each two square waves of the second forward square-wave signal. The change of the second forward square-wave signal will render the first forward square-wave signal, the reverse square-wave signal, and the second forward square-wave signal to be in logic-high state non-simultaneously, so that the trigger circuit 35 fails to trigger the switch 2. In other words, when both of the first forward square-wave signal and the reverse square-wave signal are simultaneously in logic-high state while the second forward square-wave signal is in logic-low state, the second diode D2 will be in conducting state to render the fourth node P4 in logic-low state. Consequently, the trigger circuit 35 fails to trigger the switch 2 and thus stops the heating of the heating wire 12.

Figure 7:
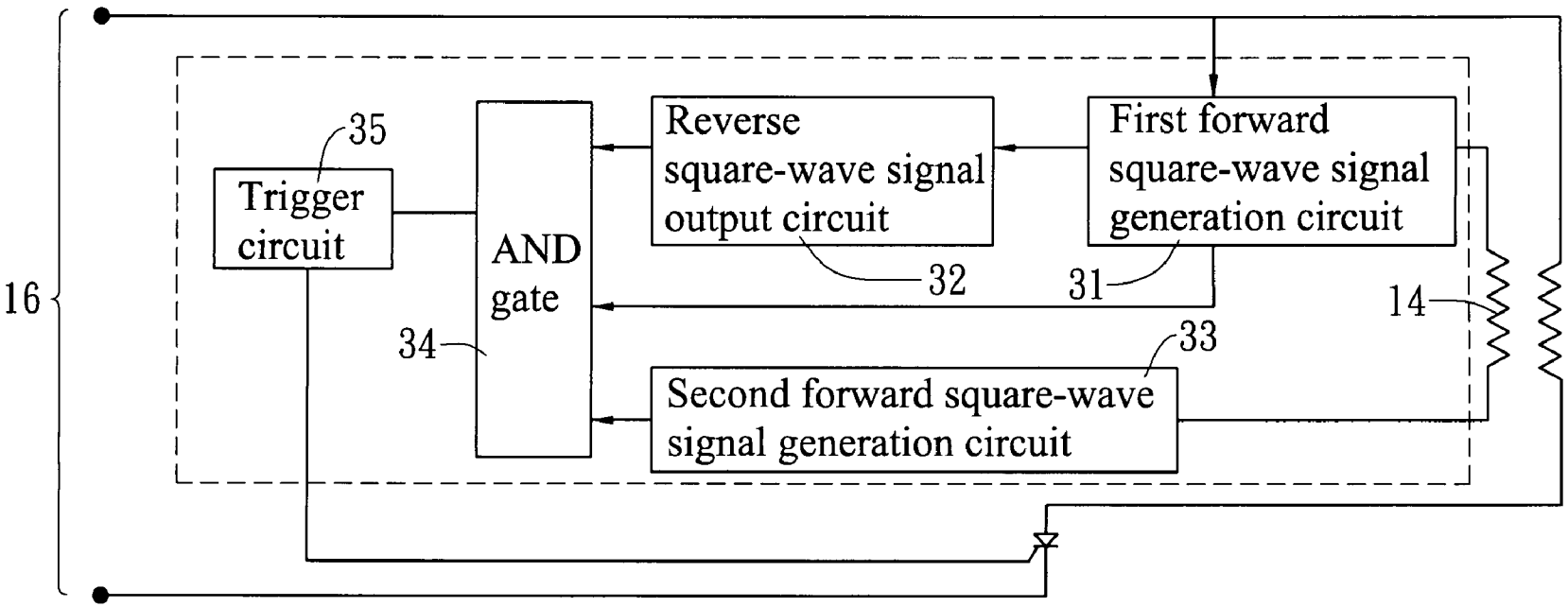
FIG. 7 is a circuit block diagram showing a second embodiment of the temperature-control circuit of the present invention.
Figure 8:
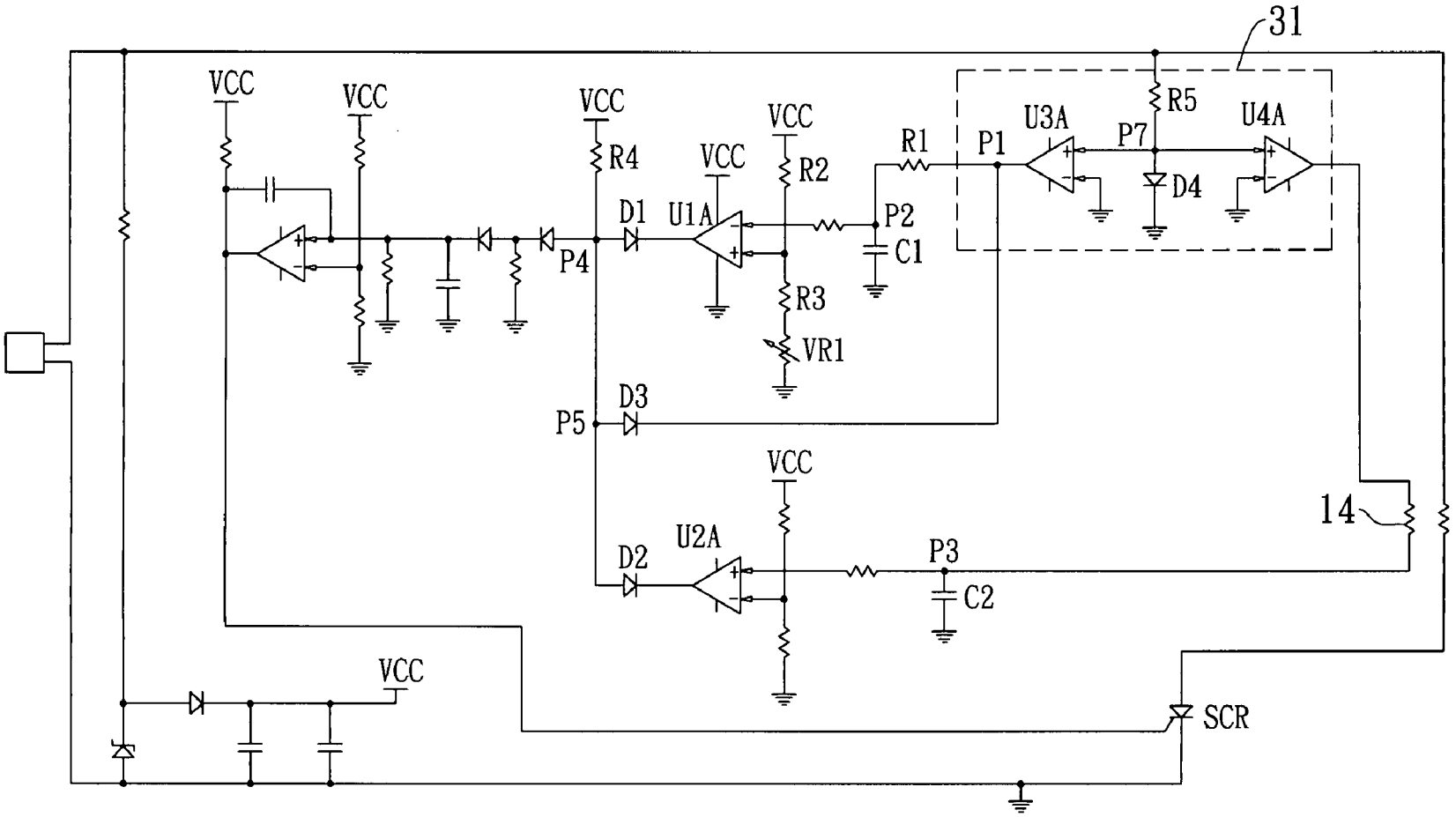
FIG. 8 is a circuit diagram showing the second embodiment of the temperature-control circuit of the present invention.

Please refer to FIGS. 7 and 8 showing a second embodiment of the temperature-control circuit of the heating line according to the present invention. In this embodiment, the first forward square-wave signal generation circuit 31 further includes a fourth voltage comparator U4A. The non-inverting input end of the fourth voltage comparator U4A is coupled with the seventh node P7. The inverting input end of the fourth comparator U4A is in ground connection. The output end of the fourth voltage comparator U4A is coupled with one end of the sensing line 14. Thereby, the sine wave signal of the power 16 is output to be the forward square-wave signal via the fourth voltage comparator U4A. The forward square-wave signal is charged and discharged by the second RC circuit that is composed of the sensing line 14 and the second capacitor C2 and then is input into the second voltage comparator U2A so as to output the second forward square-wave signal.

Figure 9:
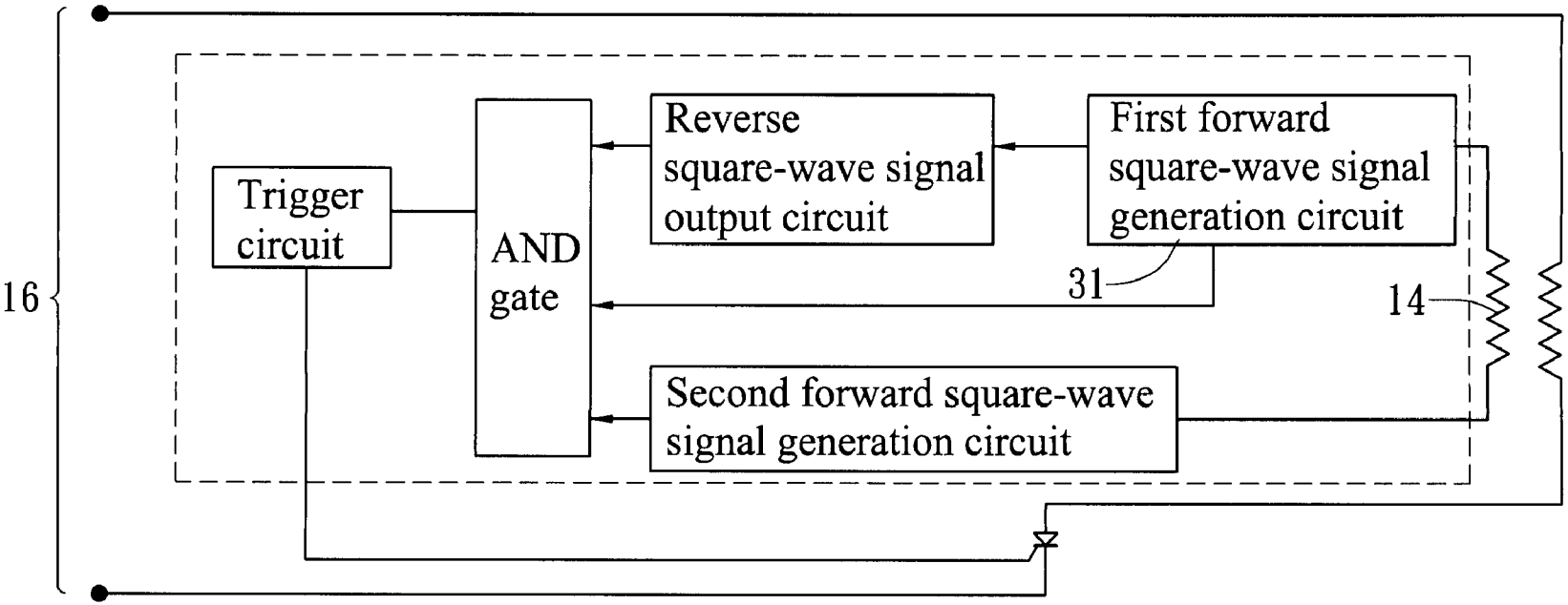
FIG. 9 is a circuit block diagram showing a third embodiment of the temperature-control circuit of the present invention.

Please refer to FIG. 9 showing a third embodiment of the temperature-control circuit of the heating line according to the present invention. In this embodiment, the first forward square-wave signal generation circuit 31 is coupled with one end of the sensing line 14. The first forward square-wave signal generation circuit 31 is a square-wave signal generator used for outputting the first forward square-wave signal directly. In this case, the power 16 is an AC power and the switch 2 is a silicon-controlled-rectifier (SCR). Besides, the switch 2 also can be a thyristor, such as a TRIAC. In practice, the power 16 also can be a DC power and the switch can be a metal-oxide-semiconductor field-effect transistor (MOSFET).

Figure 10:
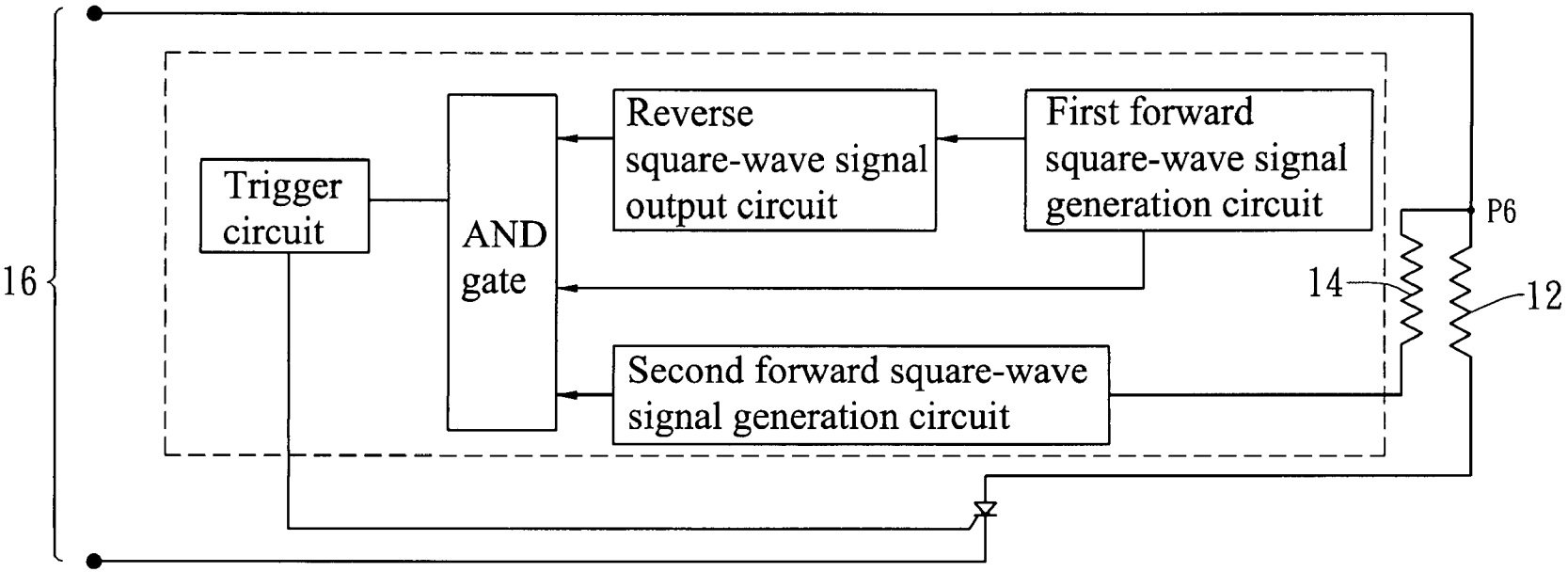
FIG. 10 is a circuit block diagram showing a fourth embodiment of the temperature-control circuit of the present invention.

Please refer to FIG. 10 showing a fourth embodiment of the temperature-control circuit of the heating line according to the present invention. This embodiment differs from the third embodiment in following aspects. A sixth node P6 is provided between one polarity of the power 16 and the heating wire 12. One end of the sensing line 14 is coupled with the sixth node P6. Consequently, the second forward square-wave signal also can be output via the second voltage comparator U2A.

Therefore, the present invention has following advantages:

1. According to the present invention, whether the heating wire begins to heat is determined by the structure and concept of the AND gate. However, according to the conventional heating structure, whether the circuit is in conducting or in disconnecting state is controlled by the continual calculation of a controller so as to keep the heating temperature within a certain range. Consequently, the structure of the present invention is simple and the manufacturing cost can be decreased effectively.
2. According to the present invention, the reference voltage of the voltage adjustment circuit is adjustable according to needs in order to output different reverse square waves. Thereby, users are provided with a mechanism of setting temperature according to their needs.

As disclosed in above descriptions and attached drawings, the present invention provides a temperature-control circuit of a heating line and a temperature-control method thereof with advantages of effective control of temperature, simple structure, and saving manufacturing cost. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A temperature-control circuit of a heating line, where the heating line comprises a heating wire, a sensing line, an insulation-and-meltable layer located between the heating wire and the sensing line, and a cladding layer covering the outer peripheries of the sensing line and the insulation-and-meltable layer; one end of the heating wire is coupled with one polarity of power while another end thereof is connected with a switch that is coupled with a reverse polarity of the power; the temperature-control circuit comprising:

a first forward square-wave signal generation circuit, for outputting a first forward square-wave signal;

a reverse square-wave signal output circuit, including a first RC circuit, a first voltage comparator, and a voltage adjustment circuit, where the RC circuit is in serial connection with the first forward square-wave signal generation circuit; a first node is provided between the first RC circuit and the first forward square-wave signal generation circuit while a second node is provided between the resistor and the capacitor of the first RC circuit; the non-inverting input end of the first voltage comparator is coupled with the voltage adjustment circuit for inputting an adjusted voltage; the inverting input end of the first voltage comparator is coupled with the second node for outputting reverse square-wave;

a second forward square-wave signal generation circuit, including a capacitor and a second voltage comparator, where the capacitor is in serial connection with the sensing line; a third node is provided between the sensing line and the capacitor; and the non-inverting input end of the second voltage comparator is coupled with the third node for outputting second square-wave signal;

an AND gate, provided with three input ends that are respectively connected with the output end of the first voltage comparator, the first node, and the output end of the second voltage comparator; and a trigger circuit, respectively connected with the output ends of the AND gate and the switch, so that when the three input ends of the AND gate have logic-high input simultaneously, the switch is triggered to be in conducting state to heat the heating wire; when the three input ends of the AND gate have logic-high input non-simultaneously, the switch is not triggered so as to stop the heating of the heating wire.

2. The temperature-control circuit of a heating line as claimed in claim 1, further comprising a core material, wherein the heating wire is coiled around the outer peripheries of the core material.

3. The temperature-control circuit of a heating line as claimed in claim 1, wherein the heating wire is a conducting wire of positive temperature coefficient or a conducting wire of negative temperature coefficient.

4. The temperature-control circuit of a heating line as claimed in claim 1, wherein the power is an AC power; the first forward square-wave signal generation circuit further includes a third voltage comparator; the non-inverting input end of the third voltage comparator is coupled with one polarity of the power; and the inverting input end of the third voltage comparator is in ground connection; the output end of the third voltage comparator is coupled with the first node.

5. The temperature-control circuit of a heating line as claimed in claim 4, wherein the power is an AC power and the switch is a thyristor.

6. The temperature-control circuit of a heating line as claimed in claim 4, wherein a sixth node is provided between one polarity of the AC power and the heating wire, and one end of the sensing line is coupled with the sixth node.

7. The temperature-control circuit of a heating line as claimed in claim 4, further including a fourth voltage comparator; the non-inverting input end of the fourth voltage comparator is coupled with one polarity of the power; and the inverting input end of the fourth voltage comparator is in ground connection; and the output end of the fourth voltage comparator is coupled with one end of the sensing line.

8. The temperature-control circuit of a heating line as claimed in claim 1, wherein the first forward square-wave signal generation circuit is a square-wave signal generator.

9. The temperature-control circuit of a heating line as claimed in claim 8, wherein a sixth node is provided between one polarity of the power and the heating wire, and one end of the sensing line is coupled with the sixth node.

10. The temperature-control circuit of a heating line as claimed in claim 9, wherein the power is an AC power and the switch is a thyristor.

11. The temperature-control circuit of a heating line as claimed in claim 9, wherein the power is a DC power and the switch is a metal-oxide-semiconductor field-effect transistor.

12. The temperature-control circuit of a heating line as claimed in claim 8, wherein the square-wave signal generator is coupled with one end of the sensing line.

13. The temperature-control circuit of a heating line as claimed in claim 12, wherein the power is an AC power and the switch is a thyristor.

14. The temperature-control circuit of a heating line as claimed in claim 12, wherein the power is a DC power and the switch is a metal-oxide-semiconductor field-effect transistor.

15. The temperature-control circuit of a heating line as claimed in claim 1, wherein the AND gate further includes a first diode, a second diode, and a third diode, where one end of the second diode is connected with the output end of the second voltage comparator while another end of the second diode is connected with the one polarity of the power; a fourth node and a fifth node are provided between the second diode and one polarity of the power; two ends of the first diode are respectively coupled with the output end of the first voltage comparator and the fourth node; and the two ends of the third diode are respectively coupled with the first node and the fifth node.

* * * * *